US011165203B2

(12) United States Patent
Shen et al.

(10) Patent No.: US 11,165,203 B2
(45) Date of Patent: Nov. 2, 2021

(54) SOCKET

(71) Applicant: Luxshare Precision Industry (Kunshan) Co., Ltd., Kunshan (CN)

(72) Inventors: RongXin Shen, Kunshan (CN); XingRan Tang, Kunshan (CN); YunBo Linghu, Kunshan (CN)

(73) Assignee: LUXSHARE PRECISION INDUSTRY (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 16/909,670

(22) Filed: Jun. 23, 2020

(65) Prior Publication Data

US 2021/0218199 A1 Jul. 15, 2021

(30) Foreign Application Priority Data

Jan. 10, 2020 (CN) ..... 202010027728.9

(51) Int. Cl.
*H01R 13/6584* (2011.01)
*H01R 13/652* (2006.01)

(52) U.S. Cl.
CPC ..... *H01R 13/6584* (2013.01); *H01R 13/652* (2013.01)

(58) Field of Classification Search
CPC ..... H01R 13/652; H01R 13/6584; H01R 13/447; H01R 13/46; H01R 13/6463; H01R 13/622
See application file for complete search history.

(56) References Cited

U.S. PATENT DOCUMENTS 3,426,197 A * 2/1969 Schwartzman ..... G21F 1/10 250/392
2012/0208404 A1* 8/2012 Matsumoto ..... H01R 13/447 439/661
2013/0149884 A1* 6/2013 Shaw ..... H01R 13/46 439/275
2015/0104964 A1* 4/2015 McIntosh ..... H01R 13/523 439/271

(Continued)

FOREIGN PATENT DOCUMENTS

CN 206163834 U 5/2017
CN 206628668 U 11/2017

(Continued)

*Primary Examiner* — Jean F Duverne
(74) *Attorney, Agent, or Firm* — Birch, Stewart, Kolasch & Birch, LLP

(57) ABSTRACT

The present disclosure provides a socket comprising a grounding part, a first shielding part, a plastic core, and a terminal. The grounding part comprises a first surface and a second surface opposite to the first surface. The grounding part comprises a first perforation. The first shielding part is disposed in the first perforation. The first shielding part comprises a shielding ring. The first connecting part is disposed on one side of the shielding ring close to the second surface. The plastic core is disposed in the first shielding part. An outer surface of the plastic core is provided with a sleeve and a second connecting part disposed on one side of the sleeve close to the second surface. The shielding ring is disposed on the sleeve. The first connecting part is in contact with the second connecting part. The terminal is disposed in the plastic core.

26 Claims, 11 Drawing Sheets

(56) References Cited

U.S. PATENT DOCUMENTS

| | | | | |
|---|---|---|---|---|
| 2016/0204556 | A1* | 7/2016 | Lin | H01R 13/6463 439/578 |
| 2018/0006420 | A1* | 1/2018 | Urtz, Jr. | H01R 13/622 |
| 2019/0103737 | A1* | 4/2019 | Weaver | H01R 43/20 |

FOREIGN PATENT DOCUMENTS

| | | | |
|---|---|---|---|
| CN | 107453075 | A | 12/2017 |
| CN | 206922103 | U | 1/2018 |
| CN | 208489477 | U | 2/2019 |
| CN | 109449638 | A | 3/2019 |
| CN | 209183805 | U | 7/2019 |
| CN | 209860272 | U | 12/2019 |

* cited by examiner

SOCKET

CROSS REFERENCE TO RELATED APPLICATION

This application claims the priority benefit of Chinese Patent Application Serial Number CN202010027728.9, filed on Jan. 10, 2020, the full disclosure of which is incorporated herein by reference.

BACKGROUND

Technical Field

The present disclosure relates to the technical field of electrical connector, and more particularly to a socket.

Related Art

Conventional electrical connectors are commonly provided with electromagnetic shields. By grounding the electromagnetic shields, it is possible to prevent the signal from escaping during signal transmission. That is, to shield the electromagnetics generated inside the electrical connector or generated by external electronic equipment during signal transmission. Under general circumstances, the contact resistance between the electromagnetic shields and the ground should be less than 2 milliohms. Ideally, the contact resistance should be less than 0.5 milliohms. For the assembly of the components of electrical connectors, the electromagnetic shields are configured to be provided with openings. The number and size of the openings would affect the shielding performance of the electromagnetic shields. The more or larger the openings, the lower the performance of the electromagnetic shields.

SUMMARY

The embodiments of the present disclosure provide a socket intended to solve the issue of low performance of the electromagnetic shields resulted from excessive and oversized openings for the assembly of the components of electrical connectors.

The present disclosure provides a socket comprising a grounding part, a first shielding part, a plastic core, and a terminal. The grounding part comprises a first surface and a second surface opposite to the first surface. The grounding part comprises a first perforation. The first shielding part is disposed in the first perforation. The first shielding part comprises a shielding ring. The first connecting part is disposed on one side of the shielding ring close to the second surface. The plastic core is disposed in the first shielding part. An outer surface of the plastic core is provided with a sleeve and a second connecting part disposed on one side of the sleeve close to the second surface. The shielding ring is disposed on the sleeve. The first connecting part is in contact with the second connecting part. The terminal is disposed in the plastic core.

In another embodiment, the present disclosure further provides a socket comprising a grounding part, a first shielding part, a second shielding part, a plastic core, and a terminal. The grounding part comprises a first surface and a second surface opposite to the first surface. The grounding part comprises a first perforation. The first shielding part is disposed in the first perforation. The second shielding part is coupled to the first shielding part partially overlaps with the second shielding part. The plastic core is disposed in the first and the second shielding parts. The terminal is disposed in the plastic core.

One embodiment of the present disclosure could enhance the electromagnetic shielding performance of the first shielding part by arranging the first shielding part around the plastic core with a very much limited gap between the first shielding part and the plastic core. Another embodiment of the present disclosure could enhance the electromagnetic shielding performance of the first and the second shielding parts by covering the plastic core with the first and the second shielding parts coupled to each other and by reducing the openings on the first and the second shielding parts as they couple to each other.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
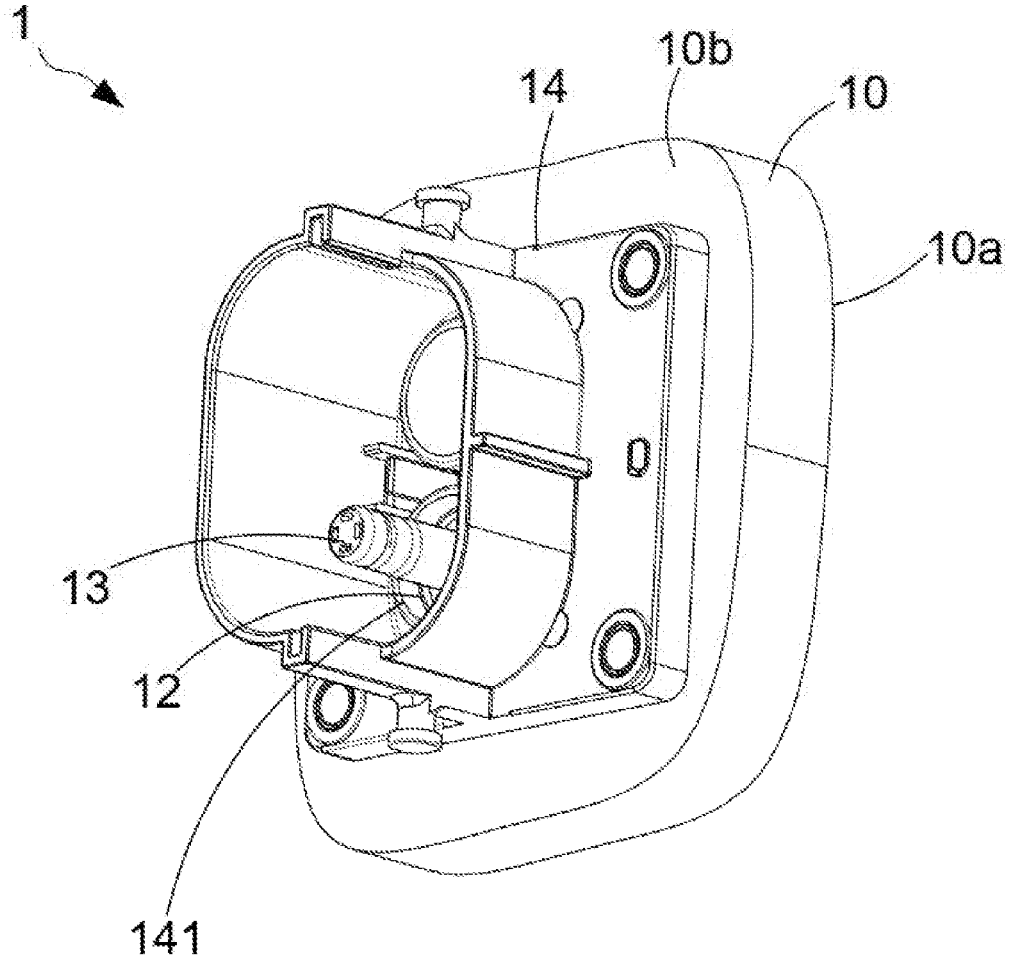
FIG. 1 is a perspective view of a socket of the first embodiment of the present disclosure.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that comprises a series of elements not only include these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

In the following embodiment, the same reference numerals are used to refer to the same or similar elements throughout the invention.

Figure 2:
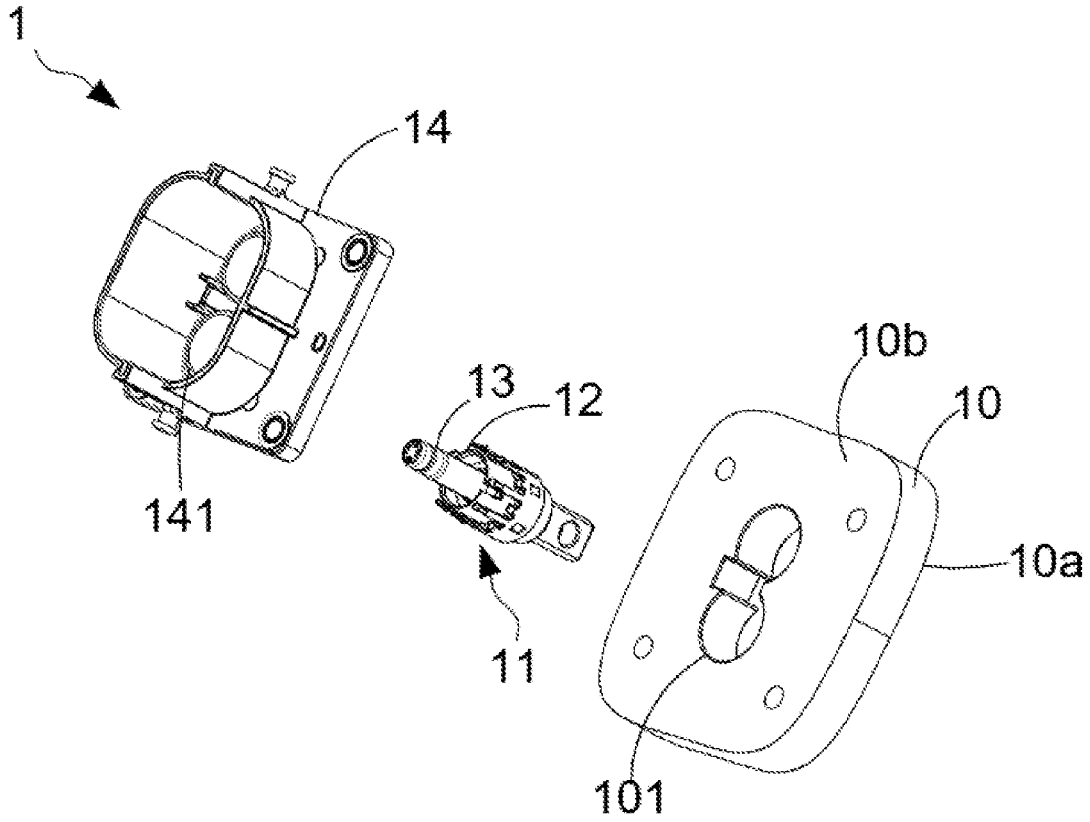
FIG. 2 is an exploded view of the socket of the first embodiment of the present disclosure.
Figure 3:
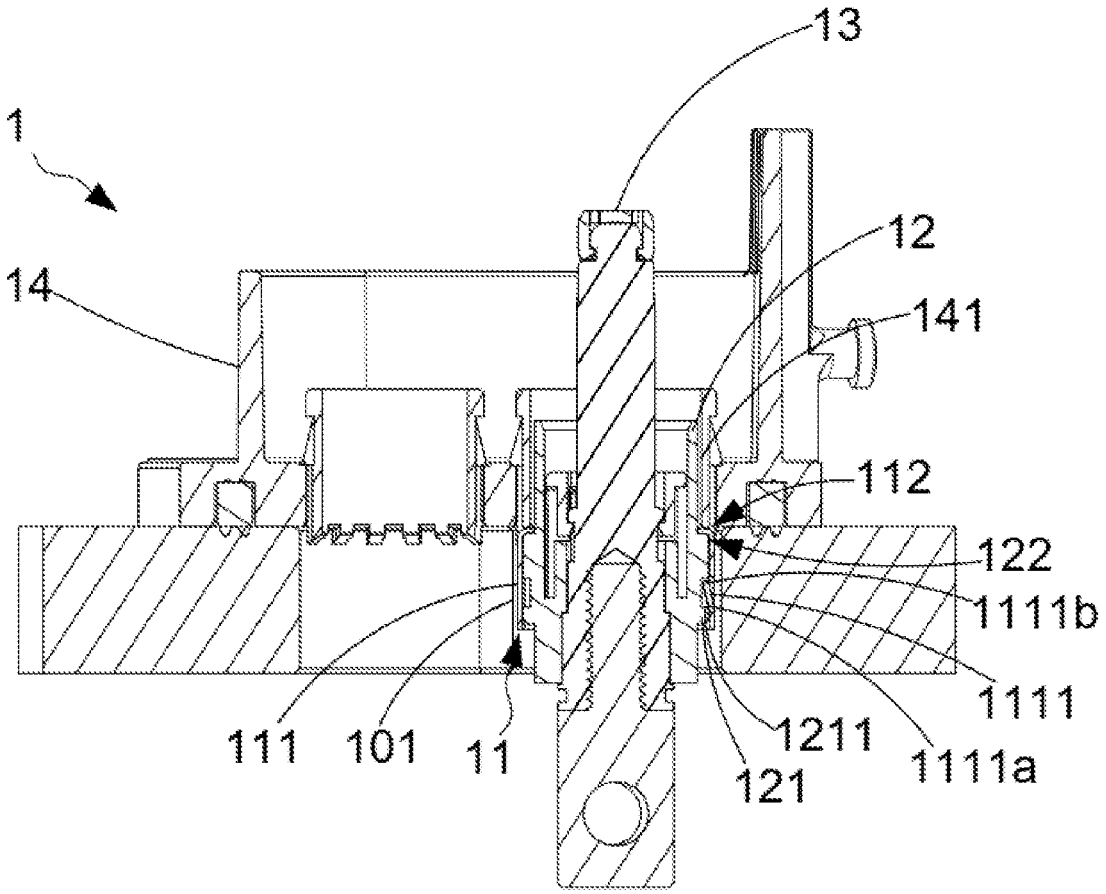
FIG. 3 is a cross-sectional view of the socket of the first embodiment of the present disclosure.
Figure 4:
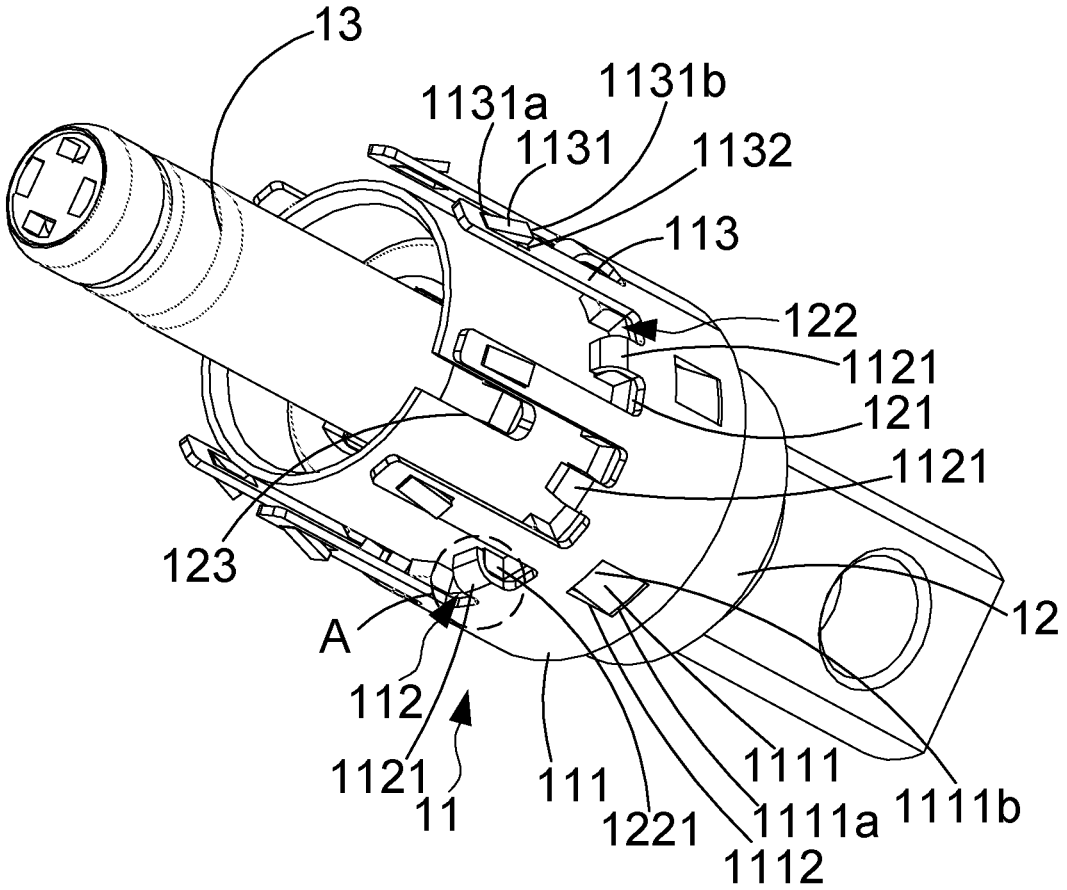
FIG. 4 is a perspective view of the assembly of the first shielding part and the plastic core of the first embodiment of the present disclosure.

FIG. 1 to FIG. 3 are a perspective view, an exploded view and a cross-sectional view of the socket of the first embodiment of the present disclosure. FIG. 4 is a perspective view of the assembly of the first shielding part and the plastic core of the first embodiment of the present disclosure. As shown in the figures, the socket 1 of the present disclosure comprises a grounding part 10, a first shielding part 11, a plastic core 12, and a terminal 13. The grounding part 10 comprises a first surface 10*a* and a second surface 10*b*. The first surface 10*a* is opposite to the second surface 10*b*. The grounding part 10 comprises a first perforation 101 penetrating the first surface 10*a* and the second surface 10*b*. The first shielding part 11 is disposed in the first perforation 101. The first shielding part 11 comprises a shielding ring 111 and a first connecting part 112. One side of the shielding ring 111 is close to the second surface 10*b*, and the other side of the shielding ring 111 is close to the first surface 10*a*. The first connecting part 112 is disposed on one side of the shielding ring 111 close to the second surface 10*b*. The plastic core 12 is disposed in the first shielding part 11. The outer surface of the plastic core 12 comprises a sleeve 121 and a second connecting part 122 disposed on one side of the sleeve 121 close to the second surface 10*b*. The shielding ring 111 is disposed on the sleeve 121. The first connecting part 112 is in contact with the second connecting part 122. The terminal 13 is disposed in the plastic core 12. The socket 1 of the present disclosure is in contact with the inner surface of the first perforation 101 of the grounding part 10 through the shielding ring 111 of the first shielding part 11, making the first shielding part 11 to be grounded to shield the electromagnetic emission generated by terminal 13 and the interference to external electronic equipment during signal transmission or to prevent the socket 1 of the present disclosure from electromagnetic interference of the external electronic equipment. As the first shielding part 11 is very close to the plastic core 12, that is, the gap between them is very much limited, the electromagnetic shielding performance of the first shielding part 11 could be enhanced.

In this embodiment, the first connecting part 112 of the first shielding part 11 comprises a plurality of connecting plates 1121 disposed at intervals on an end surface of the shielding ring 111 close to the second surface 10*b*. The plurality of connecting plates 1121 extends toward the inside of the shielding ring 111. The second connecting part 122 of the plastic core 12 comprises a plurality of connecting bumps 1221 disposed on an end surface of the sleeve 121 close to the second surface 10*b* at intervals. The plurality of connecting plates 1121 is in contact with the corresponding connecting bumps 1221. In this embodiment, the plurality of connecting plates 1121 is in contact with the corresponding connecting bumps 1221, which can prevent the plastic core 12 from detaching from one end of the first shielding part 11 close to the second surface 10*b*.

Figure 5:
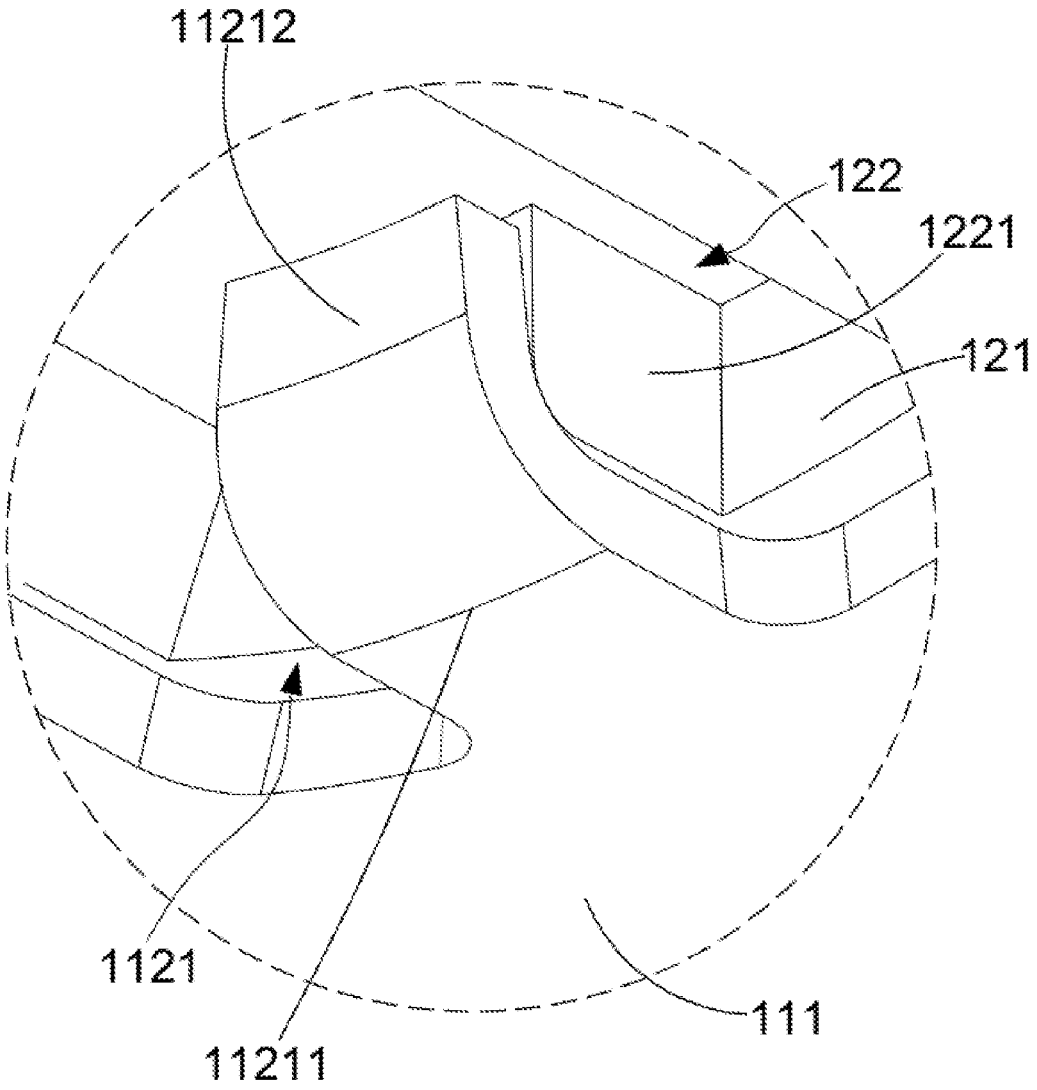
FIG. 5 is an enlarged view of area A in FIG. 4.

FIG. 5 is an enlarged view of area A in FIG. 4. In this embodiment, as shown in the figure, each of the connecting plates 1121 comprises a first connecting body 11211 and a second connecting body 11212. The first connecting body 11211 is disposed on the end surface of the shielding ring 111 close to the second surface 10*b* and extends in a direction away from the shielding ring 111. One end of the second connecting body 11212 is connected to one end of the first connecting body 11211 away from the shielding ring 111. The other end of the second connecting body 11212 extends into the shielding ring 111. A surface of the second connecting body 11212 close to the shielding ring 111 is in contact with a surface of the connecting bump 1221. In this embodiment, an angle is formed between the first connecting body 11211 and the second connecting body 11212, which can be determined according to the angle between the surface of the connecting bump 1221 away from the shielding ring 111 and the second surface 10*b*. In this embodiment, the angle between the surface of the connecting bump 1221 away from the shielding ring 111 and the second surface 10*b* is 90 degrees. Thus, the angle between the first connecting body 11211 and the second connecting body 11212 is equal to 90 degrees or maybe even smaller than 90 degrees, so that the surface of the second connecting body 11212 close to the shielding ring 111 would be in contact with the surface of the connecting bump 1221 away from the shielding ring 111.

Back to FIG. 3 and FIG. 4, the sleeve 121 of this embodiment comprises a positioning groove 1211. The shielding ring 111 comprises a plurality of first positioning elastic sheets 1111, each of which comprises a first fixed end 1111*a* and a first movable end 1111*b*. The first fixed end 1111*a* is connected to the shield ring 111. The first movable end 1111*b* extends close to the surface of the sleeve 121 and abuts against the sidewall of the positioning groove 1211. In this embodiment, the first fixed end 1111*a* of the first positioning elastic sheet 1111 is close to the first surface 10*a*. The first movable end 1111*b* of the first positioning elastic sheet 1111 is close to the second surface 10*b*. The first positioning elastic sheet 1111 extends from below the shielding ring 111 to the above thereof. The first movable end 1111*b* abuts against the sidewall of the positioning groove 1211 close to the second surface 10*b*. In this way, the plastic core 12 can be prevented from detaching from the end of the first shielding part 11 close to the first surface 10*a*. In this embodiment, the positioning groove 1211 is annular. The plurality of first positioning elastic sheets 1111 abut against the same positioning groove 1211. In another embodiment, the number of the positioning grooves 1211 could be multiple. A plurality of positioning grooves 1211 is disposed on the sleeve 121 at intervals. The plurality of first positioning elastic sheets 1111 abut against the corresponding positioning groove 1211.

In one embodiment, the shielding ring 111 of this embodiment comprises a plurality of first retaining holes 1112. The first fixed end 1111*a* of each of the first positioning elastic sheets 1111 is connected to the inner sidewall of the corresponding first retaining hole 1112. In this embodiment, the first fixed end 1111*a* of the first positioning elastic sheet 1111 is connected to the inner sidewall parallel to the corresponding first retaining hole 1112 and the end surface of the shielding ring 111 close to the first surface 10*a*. The area of the first retaining hole 1112 is larger than that of the first positioning elastic sheet 1111, especially the width of the first retaining hole 1112 is greater than or equal to that of the first positioning elastic sheet 1111, and the length of the first retaining hole 1112 is greater than or equal to that of the first positioning elastic sheet 1111. In this way, the first retaining hole 1112 is able to receive the first positioning elastic sheet 1111. When the plastic core 12 is installed on the first shielding part 11, the plastic core 12 would firstly push a plurality of first positioning elastic sheets 1111, enabling the plurality of first positioning elastic sheets 1111 to enter the corresponding first retaining holes 1112 respectively, so that the plastic core 12 could enter the first shielding part 11. The positioning groove 1211 of the plastic core 12 corresponds to a plurality of first positioning elastic sheets 1111 as the plastic core 12 keeps moving in the first shielding part 11. The plurality of first positioning elastic sheets 1111 would be respectively ejected from the corresponding first retaining holes 1112 and abut against the sidewall of the positioning groove 1211 respectively.

In one embodiment, the socket 1 of this embodiment further comprises a socket housing 14 disposed on the second surface 10*b* of the grounding part 10. The socket housing 14 comprises a second perforation 141 corresponds to the first perforation 101. The first shielding part 11, the plastic core 12, and the terminal 13 are disposed in the first perforation 101 and the second perforation 141.

Figure 6:
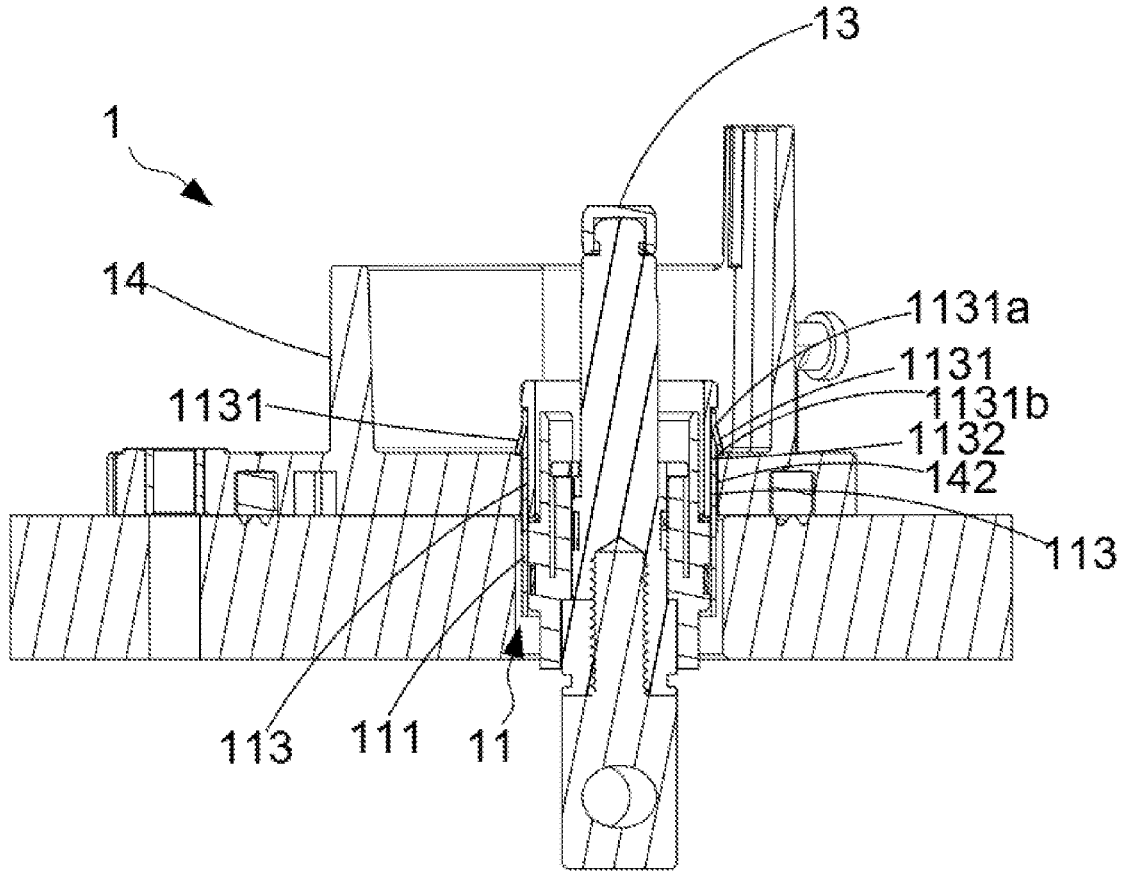
FIG. 6 is another cross-sectional view of the socket of the first embodiment of the present disclosure.

In one embodiment, the first shielding part 11 of this embodiment further comprises a plurality of positioning parts 113 disposed on the end surface of the shielding ring 111 close to the second surface 10*b* at intervals. Each of the positioning parts 113 is disposed on two adjacent connecting plates 1121. One end of each of the positioning parts 113 away from the shielding ring 111 is connected to the socket housing 14. In this way, the first shielding part 11 is secured into the socket housing 14 through a plurality of positioning parts 113. Refer to FIG. 6, another cross-sectional view of the socket of the first embodiment of the present disclosure, one end of each of the positioning parts 113 away from the shielding ring 111 comprises a plurality of second positioning elastic sheets 1131 comprising a second fixed end 1131*a* away from the shielding ring 111 and a second movable end 1131*b* close to the shielding ring 111. The second movable end 1131*b* of the second positioning elastic sheet 1131 extends toward the inner surface of the socket housing 14. The socket housing 14 comprises a plurality of positioning holes 142 disposed at intervals. The plurality of positioning holes 142 are disposed on the circumference of the second perforation 141. Each of the second positioning elastic sheets 1131 passes through a corresponding positioning hole 142. The second movable end 1131*b* abuts against the surface of the socket housing 14 around the positioning hole 142.

In one embodiment, a second retaining hole 1132 is provided on one end of each of the positioning parts 113 away from the shielding ring 111. The second fixed end 1131*a* of the second positioning elastic sheet 1131 is connected to the inner sidewall of the corresponding second retaining hole 1132. In this embodiment, the second fixed end 1131*a* of the second positioning elastic sheet 1131 is connected to the inner sidewall parallel to the corresponding second retaining hole 1132 and the end surface of the positioning part 113 away from the shielding ring 111. The area of the second retaining hole 1132 is larger than that of the first positioning elastic sheet 1131, especially the width of the second retaining hole 1132 is greater than or equal to that of the second positioning elastic sheet 1131, and the length of the second retaining hole 1112 is greater than or equal to that of the second positioning elastic sheet 1131. In this way, the second retaining hole 1132 is able to receive the second positioning elastic sheet 1131. When the socket housing 14 is installed on the first shielding part 11, the second positioning elastic sheet 1131 of each of the positioning parts 113 passes through the corresponding positioning hole 142. The sidewall of the positioning hole 142 pushes a plurality of second positioning elastic sheets 1131, enabling each of the plurality of second positioning elastic sheets 1131 to enter the corresponding second retaining hole 1132 respectively so that the socket housing 14 could be installed onto the first shielding part 11. Each of the second positioning elastic sheets 1131 penetrates through the corresponding positioning hole 142 as the socket housing 14 keeps moving towards the grounding part 10. Each of the second positioning elastic sheets 1131 would be respectively ejected from the corresponding second retaining holes 1132 and abuts against the surface of the socket housing 14 around the positioning hole 142.

Figure 7:
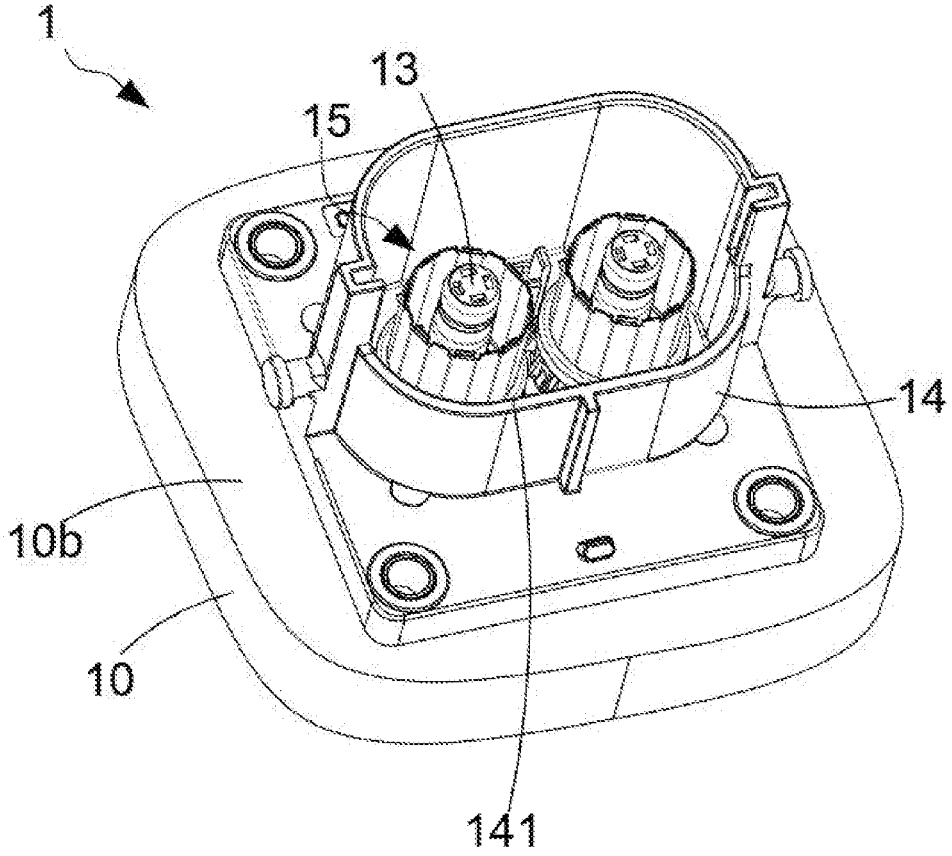
FIG. 7 is a perspective view of a socket of the second embodiment of the present disclosure.
Figure 8:
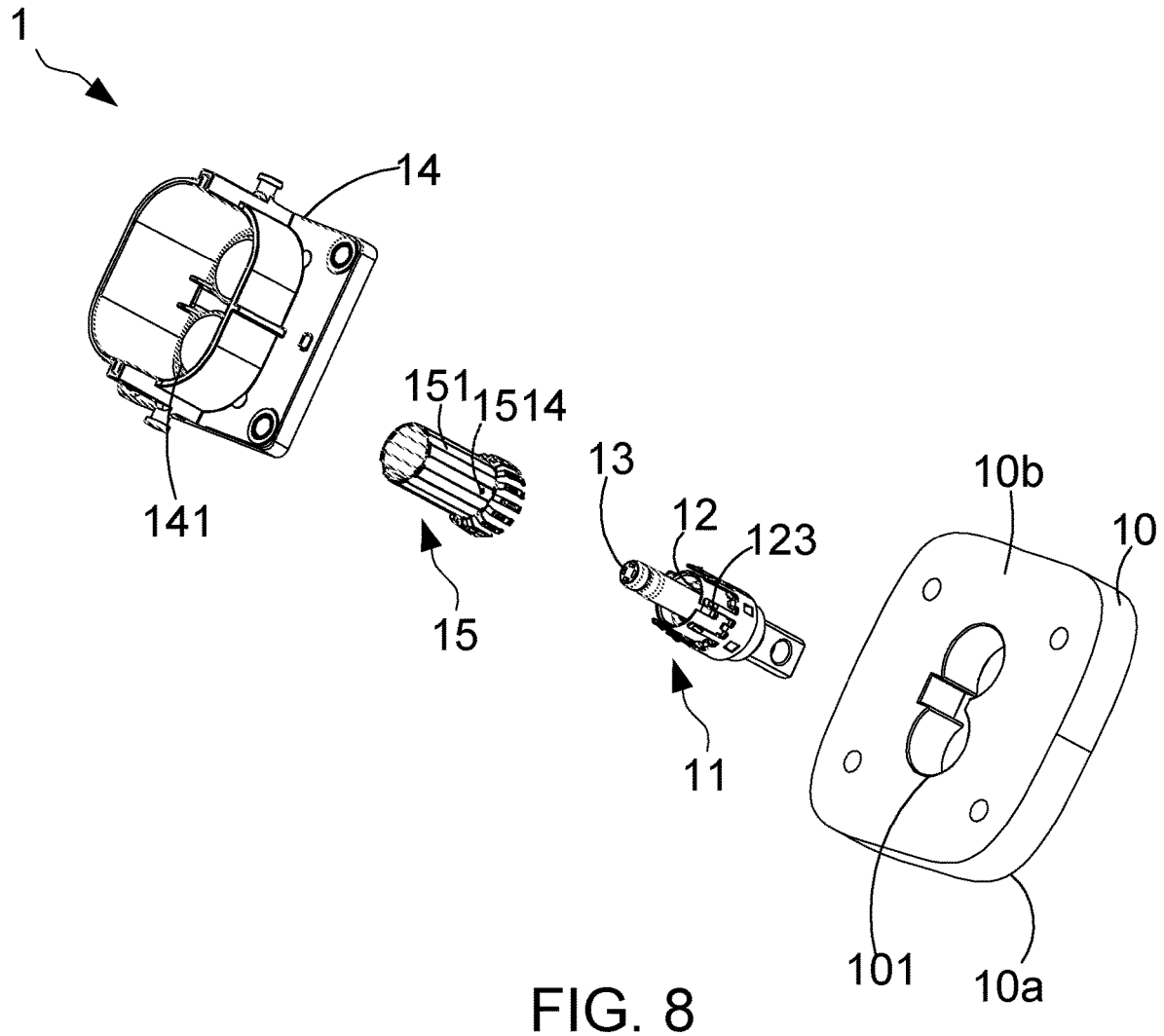
FIG. 8 is an exploded view of the socket of the second embodiment of the present disclosure.

FIG. 7 and FIG. 8 are perspective and exploded views of the socket of the second embodiment of the present disclosure. The socket 1 of this embodiment is different from that of the first embodiment in that the socket 1 of this embodiment further comprises a second shielding part 15 coupled to the first shielding part 11 partially overlaps with the second shielding part 15. The plastic core 12 is disposed in the first shielding part 11 and the second shielding part 15. The first shielding part 11, the second shielding part 15, the plastic core 12 and the terminal 13 are disposed in the first perforation 101 of the grounding part 10 and the second perforation 141 of the socket housing 14. In this embodiment, the second shielding part 15 of the socket 1 is in contact with the inner surface of the first perforation 101 of the grounding part 10, which grounds the second shielding part 15 to achieve the effect of electromagnetic shielding. The plastic core 12 is covered by the first shielding part 11 and the second shielding part 15 so as to increase the area of the electromagnetic shielding. As the number of the openings between the first shielding part 11 and the second shielding part 15 are very much limited and the size of them is small, the first shielding part 11 and the second shielding part 15 could thereby perform excellent electromagnetic shielding.

Figure 9:
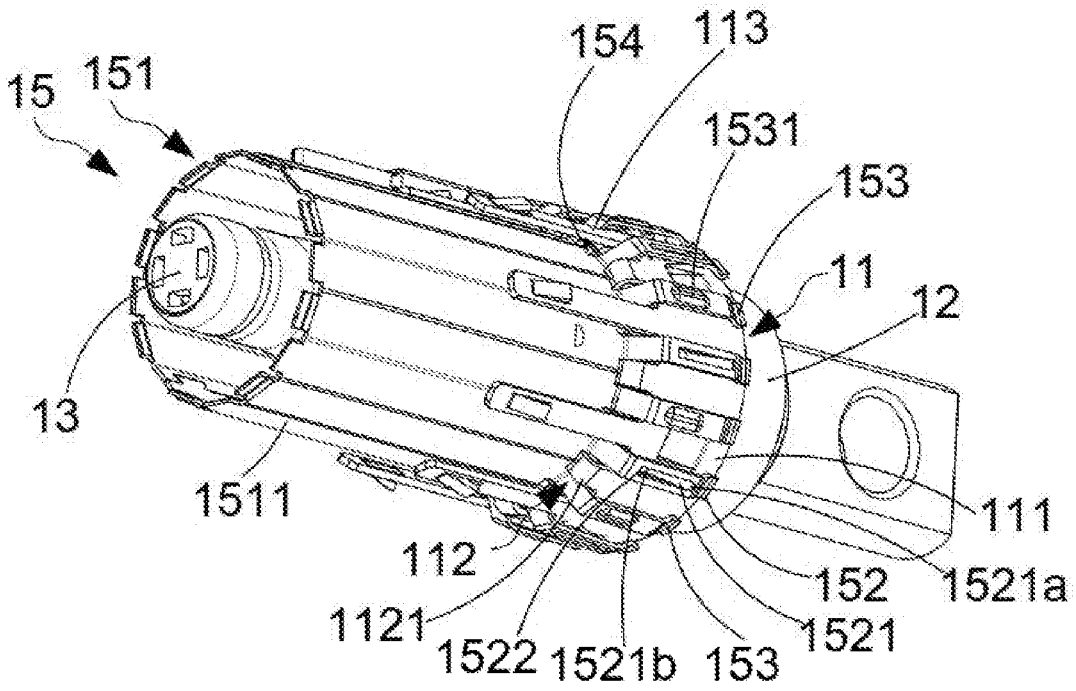
FIG. 9 is a perspective view of the assembly of the first and the second shielding parts of the second embodiment of the present disclosure.
Figure 10:
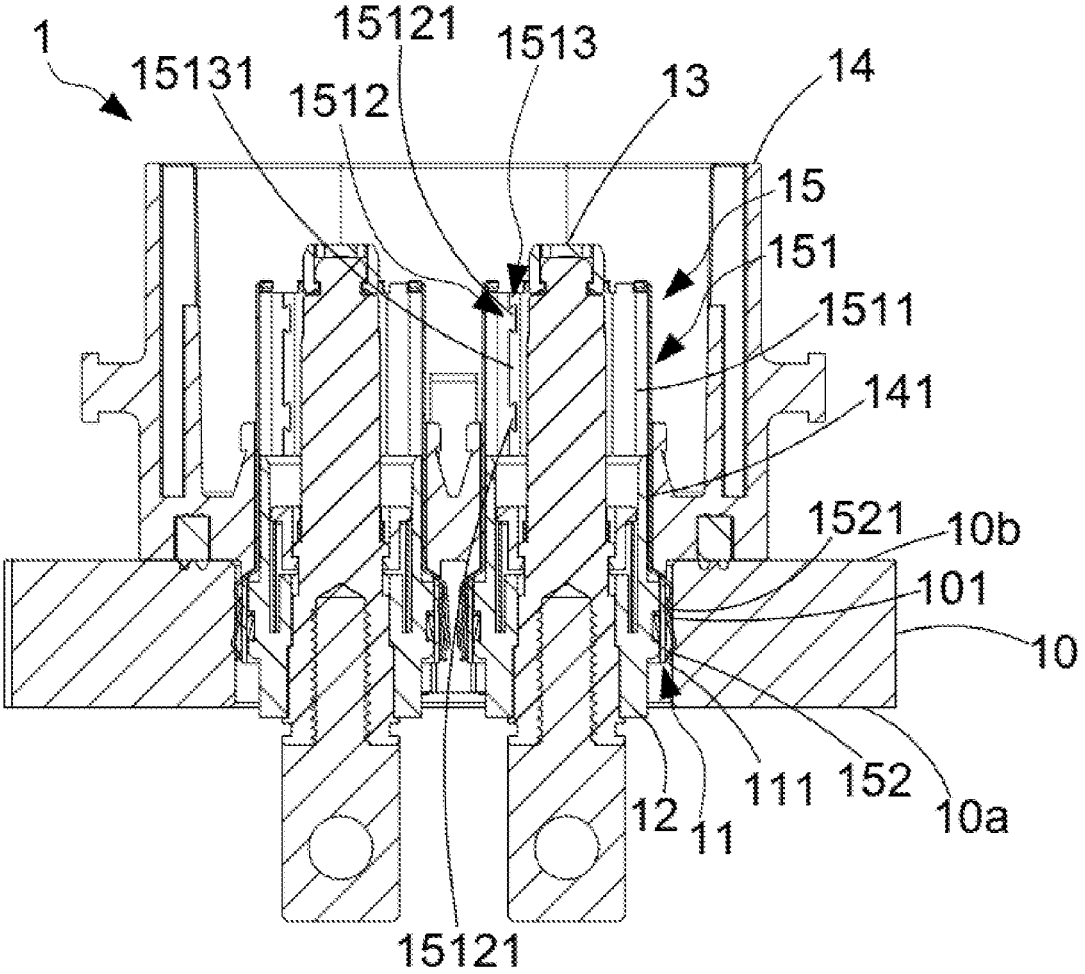
FIG. 10 is a cross-sectional view of the socket of the second embodiment of the present disclosure.
Figure 11:
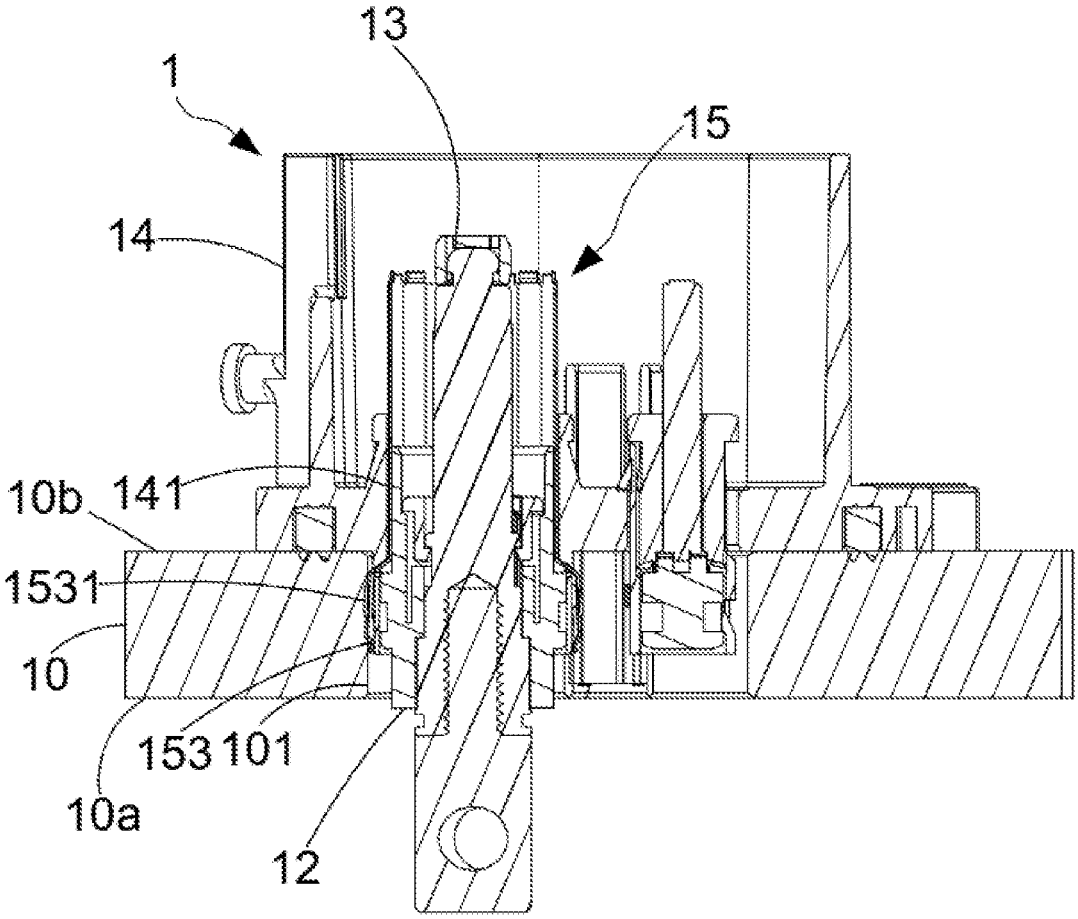
FIG. 11 is another cross-sectional view of the socket of the second embodiment of the present disclosure.

FIG. 9 is a perspective view of the assembly of the first and the second shielding parts of the second embodiment of the present disclosure, and FIG. 10 and FIG. 11 are cross-sectional views of the socket of the second embodiment of the present disclosure. As shown in the figures, the second shielding part 15 comprises a shielding body 151, a plurality of first contacting parts 152, and a plurality of second contacting parts 153. The plurality of first contacting parts 152 and the plurality of second contacting parts 153 are disposed on one end of the shielding body 151 at intervals. The plurality of first contacting parts 152 and the plurality of second contacting parts 153 extend toward the first surface 10*a*. The plurality of first contacting parts 152 are in contact with the outer surface of the shielding ring 111. The plurality of second contacting parts 153 are in contact with the sidewall of the first perforation 101. When the second shielding part 15 is coupled to the first shielding part 11, the plurality of first contacting parts 152 and the plurality of second contacting parts 153 would be disposed on the outer surface of the shielding ring 111 of the first shielding part 11, and each of the connecting plates 1121 of the first connecting part 112 would be disposed between the adjacent first contacting part 152 and the second contacting part 153.

Each of the first contacting parts 152 comprises a elastic contacting plate 1521 comprising a contacting fixed end 1521*a* and a contacting movable end 1521*b* farther from the first surface 10*a* than the contacting fixed end 1521*a*. The elastic contacting plate 1521 extends toward the outer surface of the shielding ring 111 so that the contacting movable end 1521*b* can contact the shielding ring 111.

In one embodiment, each of the first contacting parts 152 comprises a retaining hole 1522. The contacting fixed end 1521*a* of the elastic contacting plate 1521 is connected to the inner sidewall of the retaining hole 1522. In this embodiment, the contacting fixed end 1521*a* of the elastic contacting plate 1521 is connected to the inner sidewall parallel to the retaining hole 1522 and the first surface 10*a*. The area of the retaining hole 1522 is larger than that of the elastic contacting plate 1521, especially the width of the retaining hole 1522 is greater than or equal to that of the elastic contacting plate 1521, and the length of the first retaining hole 1522 is greater than or equal to that of the elastic contacting plate 1521. In this way, the retaining hole 1522 is able to receive the elastic contacting plate 1521. When the first shielding part 11 is installed on the second shielding part 15, the shielding ring 111 would firstly push the elastic contacting plate 1521 of each of the first contacting parts 152, enabling the elastic contacting plate 1521 to enter the corresponding retaining holes 1522 respectively, so that the first shielding part 11 could enter the second shielding part 15. The plurality of elastic contacting plates 1521 corresponds to the shielding ring 111 as the first shielding part 11 keeps moving in the second shielding part 15. Each of the elastic contacting plates 1521 would be respectively ejected from the corresponding retaining holes 1522 and abuts against the outer surface of the shielding ring 111.

In this embodiment, each of the second contacting parts 153 comprises a contacting bump 1531 disposed on the surface of the second contacting part 153 away from the shielding ring 111. The contacting bump 1531 is in contact with the sidewall of the first perforation 101, and the second shielding part 15 is connected to the grounding part 10, which grounds the second shielding part 15.

In this embodiment, the shielding body 151 is a bent metal plate 1511. Two ends of the metal plate 1511 are respectively provided with a first riveting joint 1512 and a second riveting joint 1513 being connected to the first riveting joint 1512 forming a shielding body 151 as the metal plate 1511 is bent. In this embodiment, the cross-sectional shape of the shielding body 151 is polygonal. The first riveting joint 1512 comprises a plurality of first riveting blocks 15121 disposed at intervals. The second riveting joint 1513 comprises a plurality of second riveting blocks 15131 disposed at intervals. Each second riveting block 15131 is disposed between two adjacent first riveting blocks 15121. In this embodiment, the width of the first riveting block 15121 close to the metal plate 1511 is smaller than that of the first riveting block 15121 away from the metal plate 1511, so that an angle is formed between two opposite sides of the first riveting block 15121 and an edge of the metal plate 1511. Similarly, the width of the second rivet block 15131 close to the metal plate 1511 is smaller than the width of the second rivet block 15131 away from the metal plate 1511, so that an angle is formed between two opposite sides of the second riveting block 15131 and an edge of the metal plate 1511. When each second riveting block 15131 is disposed between two adjacent first riveting blocks 15121, the second riveting block 15131 could respectively enter an angle between the two opposite sides of the first riveting block 15121 and the edge of the metal plate 1511, the first riveting block 15121 could respectively enter an angle between the two opposite sides of the second riveting block 15131 and the edge of the metal plate 1511, and the two opposite sides of the second riveting block 15131 can respectively abut against the sides of the corresponding first riveting block 15121. In this way, the first riveting joint 1512 could engage with the second riveting joint 1513.

In one embodiment, a guiding bump 1514 is provided on an inner surface of the shielding body 151. In this embodiment, the guiding bump 1514 is stamped out from an outer surface of the shielding body 151 in a direction toward the inner surface of the shielding body 151 by stamping. The plastic core 12 comprises a guiding groove 123. The guiding bump 1514 is disposed in the guiding groove 123 and abuts against the bottom surface of the guiding groove 123. Thus, the plastic core 12 can be secured to the second shielding part 15 and can prevent the second shielding part 15 from being detached in a direction away from the grounding part 10.

In one embodiment, the second shielding part 15 further comprises a plurality of shielding block 154 disposed on an end surface of the shielding body 151 close to the grounding part 10 at intervals. Each of the shielding blocks 154 is disposed between the adjacent first contacting part 152 and the second contacting part 153. The plurality of shielding blocks 154 respectively extends to the corresponding plurality of positioning parts 113. Therefore, the electromagnetic shielding performance of the first shielding part 11 and the second shielding part 15 could be effectively enhanced by reducing the gap between each of the positioning parts 113 and the shielding body 151 through the shielding blocks 154.

In summary, the present disclosure provides a socket effectively enhancing the shielding performance of the first shielding part 11 by reducing the gap between the first shielding part and the plastic core through the annular configuration of the first shielding part around the plastic core. On the other hand, the entire plastic core is covered by the first shielding part and the second shielding part coupled to each other. Therefore, the shielding performance of the first and second shielding part could be improved resulting from the reduction of openings on the two shielding parts as they are coupled to each other.

It is to be understood that the term "comprises", "comprising", or any other variants thereof is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A socket, comprising:

a grounding part comprising a first surface and a second surface opposite to the first surface; the grounding part comprising a first perforation penetrating the first surface and the second surface;

a first shielding part disposed in the first perforation, the first shielding part comprising a shielding ring and a first connecting part; the first connecting part being disposed on one side of the shielding ring close to the second surface;

a plastic core disposed in the first shielding part; an outer surface of the plastic core is provided with a sleeve and a second connecting part; the second connecting part being disposed on one side of the sleeve close to the second surface; the shielding ring is disposed on the sleeve; the first connecting part being in contact with the second connecting part, the first shielding part being close to the plastic core, and a limited gap being between the first shielding part and the plastic core; and a terminal disposed in the plastic core.

2. The socket according to claim 1, wherein the first connecting part comprises a plurality of connecting plates disposed at intervals on an end surface of the shielding ring close to the second surface; the plurality of connecting plates extends into the shielding ring; the second connecting part comprises a plurality of connecting bumps disposed at intervals on an end surface of the sleeve close to the second surface; the plurality of connecting plates is respectively in contact with the corresponding connecting bumps.

3. The socket according to claim 2, wherein each connecting plate comprises a first connecting body and a second connecting body; the first connecting body is disposed on the end surface of the shielding ring close to the second surface; the first connecting body extends in a direction away from the shielding ring; one end of the second connecting body is connected to one end of the first connecting body away from the shielding ring; one end of the second connecting body extends into the shielding ring body; a surface of the second connecting body close to the shielding ring is in contact with a surface of the connecting bump away from the shielding ring body.

4. The socket according to claim 2, wherein the sleeve comprises a positioning groove; the shielding ring comprises a plurality of first positioning elastic sheets; each of the first positioning elastic sheets comprises a first fixed end and a first movable end; the first fixed end is connected to the shielding ring; the first movable end extends close to the surface of the sleeve; the first movable end abuts against the positioning groove.

5. The socket according to claim 4, wherein the shielding ring comprises a plurality of first retaining holes; the first fixed end of each of the first positioning elastic sheets is connected to an inner wall of the corresponding first retaining hole.

6. The socket according to claim 2, further comprising a socket housing disposed on the second surface of the grounding part; the socket housing comprises a second perforation corresponding to the first perforation; the first shielding part, the plastic core, and the terminal are disposed in the first and second perforations.

7. The socket according to claim 6, wherein the first shielding part further comprises a plurality of positioning parts disposed on the end surface of the shielding ring close to the second surface at intervals; each of the positioning parts is disposed between two adjacent connecting plates; one end of each of the positioning parts away from the shielding ring is connected to the socket housing.

8. The socket according to claim 7, wherein one end of each of the positioning parts away from the shielding ring is provided with a plurality of second positioning elastic sheets comprising a second fixed end and a second movable end; the second fixed end is away from the shielding ring; the second movable end is close to the shielding ring; the socket housing comprises a plurality of positioning holes disposed at intervals; the plurality of positioning holes is disposed at the circumference of the second perforation; each of the second positioning elastic sheets passes through the corresponding positioning hole; the second movable end abuts against a surface of the socket housing around the positioning hole.

9. The socket according to claim 8, wherein a second retaining hole is provided at one end of each of the positioning part away from the shielding ring; the second fixed end of each of the second positioning elastic sheets is connected to an inner sidewall of the corresponding second retaining hole.

10. A socket, comprising:

a grounding part comprising a first surface and a second surface opposite to the first surface; the grounding part comprising a first perforation;

a first shielding part disposed in the first perforation;

a second shielding part coupled to the first shielding part, the second shielding part being partially overlapped with the first shielding part;

a plastic core disposed in the first shielding part and the second shielding part; and a terminal disposed in the plastic core.

11. The socket according to claim 10, wherein the first shielding part comprises a shielding ring and a first connecting part disposed on one side of the shielding ring close to the second surface; an outer surface of the plastic core is provided with a sleeve and a second connecting part disposed on one side of the sleeve close to the second surface; the shielding ring is disposed on the sleeve; the first connecting part is in contact with the second connecting part.

12. The socket according to claim 11, wherein the second shielding part comprises a shielding body, a plurality of first contacting parts, and a plurality of second contacting parts; the plurality of first contacting parts and the plurality of second contacting parts are disposed at one end of the shielding body at intervals; the plurality of first contacting parts and the plurality of second contacting parts extend toward the first surface; the plurality of first contacting parts is in contact with an outer surface of the shielding ring; the plurality of second contacting parts is in contact with a sidewall of the first perforation.

13. The socket according to claim 12, wherein each of the first contacting parts is provided with an elastic contacting plate comprising a contacting fixed end and a contacting movable end; the contacting movable end farther from the first surface than the contacting fixed end contacts with the shielding ring.

14. The socket according to claim 13, wherein each of the first contacting parts comprises a retaining hole; the contacting fixed end of the elastic contacting plate is connected to an inner sidewall of the retaining hole.

15. The socket according to claim 12, wherein each of the second contacting parts comprises a contacting bump in contact with the sidewall of the first perforation.

16. The socket according to claim 12, wherein the shielding body is a bent metal plate; two ends of the metal plate are respectively provided with a first riveting joint and a second riveting joint being connected to the first riveting joint.

17. The socket according to claim 12, wherein the cross-sectional shape of the shielding body is polygonal.

18. The socket according to claim 12, wherein a guiding bump is provided on an inner surface of the shielding body; the plastic core comprises a guiding groove; the guiding bump is disposed in the guiding groove.

19. The socket according to claim 11, wherein first connecting part comprises a plurality of connecting plates disposed on an end surface of the shielding ring close to the second surface at intervals; the plurality of connecting plates extends into the shielding ring; each of the connecting plates is disposed between the adjacent first contacting part and the second contacting part; the second connecting part comprises a plurality of connecting bumps disposed on an end surface of the sleeve close to the second surface at intervals; the plurality of connecting plates is respectively in contact with the corresponding connecting bumps.

20. The socket according to claim 19, wherein the sleeve comprises a positioning groove; the shielding ring comprises a plurality of first positioning elastic sheets; each of the positioning elastic sheets comprises a first fixed end and a first movable end; the first fixed end is disposed on the shielding ring; the first fixed end is connected to the shielding ring; the first movable end extends close to the surface of the sleeve; the first movable end abuts against the positioning groove.

21. The socket according to claim 20, wherein the shielding ring comprises a plurality of first retaining holes; the first fixed end of each of the first positioning elastic sheets is connected to an inner wall of the corresponding first retaining hole.

22. The socket according to claim 12, further comprising a socket housing disposed on the second surface of the grounding part; the socket housing comprises a second perforation corresponding to the first perforation; the first shielding part, the plastic core, and the terminal are disposed in the first and second perforations.

23. The socket according to claim 22, wherein the first shielding part further comprises a plurality of positioning parts disposed on the end surface of the shielding ring close to the second surface at intervals; each of the positioning parts is disposed between two adjacent connecting plates; one end of each of the positioning parts away from the shielding ring is connected to the socket housing.

24. The socket according to claim 23, wherein one end of each of the positioning parts away from the shielding ring is provided with a plurality of second positioning elastic sheets comprising a second fixed end and a second movable end; the second fixed end is away from the shielding ring; the second movable end is close to the shielding ring; the socket housing comprises a plurality of positioning holes disposed at intervals; the plurality of positioning holes is disposed at the circumference of the second perforation; the connecting end of each of the second positioning elastic sheets passes through the corresponding positioning hole; the second movable end abuts against a surface of the socket housing around the positioning hole.

25. The socket according to claim 24, wherein a second retaining hole is provided at one end of each of the positioning part away from the shielding ring; the second fixed end of each of the second positioning elastic sheets is connected to an inner sidewall of the corresponding second retaining hole.

26. The socket according to claim 25, wherein the second shielding part further comprises a plurality of shielding block disposed on an end surface of the shielding body close to the grounding part at intervals; each of the shielding blocks is disposed between the adjacent first contacting part and the second contacting part; the plurality of shielding blocks respectively extend to the corresponding plurality of positioning parts.

* * * * *